US011111730B2

(12) United States Patent
Chanpura et al.

(10) Patent No.: US 11,111,730 B2
(45) Date of Patent: Sep. 7, 2021

(54) DOWNHOLE ADJUSTABLE DRILL BITS

(71) Applicant: Halliburton Energy Services, Inc., Houston, TX (US)

(72) Inventors: Reena Agarwal Chanpura, Sugar Land, TX (US); Ruchir Shirish Patwa, Sugar Land, TX (US); Michael Dewayne Finke, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 2 days.

(21) Appl. No.: 16/627,654

(22) PCT Filed: Aug. 4, 2017

(86) PCT No.: PCT/US2017/045604
§ 371 (c)(1),
(2) Date: Dec. 30, 2019

(87) PCT Pub. No.: WO2019/027479
PCT Pub. Date: Feb. 7, 2019

(65) Prior Publication Data

US 2021/0095526 A1 Apr. 1, 2021

(51) Int. Cl.
*E21B 10/62* (2006.01)
*E21B 47/09* (2012.01)

(52) U.S. Cl.
CPC ..... *E21B 10/62* (2013.01); *E21B 47/09* (2013.01)

(58) Field of Classification Search
CPC ..... E21B 10/62; E21B 47/09
See application file for complete search history.

(56) References Cited

U.S. PATENT DOCUMENTS

2010/0212964 A1 8/2010 Beuershausen
2012/0168228 A1 7/2012 Giroux et al.
2015/0114665 A1* 4/2015 Hora ..... E21B 29/005 166/378
2015/0362100 A1 12/2015 Li et al.
2016/0032658 A1* 2/2016 Jain ..... E21B 17/1014 175/27

(Continued)

FOREIGN PATENT DOCUMENTS

BE 1012751 3/2001
EP 1777365 A1 * 4/2007 ..... E21B 10/32
WO WO-2009146190 A1 * 12/2009 ..... E21B 7/068

OTHER PUBLICATIONS

ISRWO International Search Report and Written Opinion for PCT/US2017/045604 dated May 2, 2018.

*Primary Examiner* — Caroline N Butcher
(74) *Attorney, Agent, or Firm* — Benjamin Ford; C. Tumey Law Group PLLC

(57) ABSTRACT

A drill bit includes a bit head defining a longitudinal axis, an adjustable cutter blade having a cutting element, and a blade ramp extending transversely relative to the longitudinal axis and arranged to radially adjust the adjustable cutter blade when the adjustable cutter blade moves axially along a side of the bit head. The drill bit further includes a gauge pad coupled to the adjustable cutter blade and a gauge pad ramp extending transversely relative to the longitudinal axis and arranged to radially adjust the gauge pad when the gauge pad moves axially along the side of the bit head.

20 Claims, 6 Drawing Sheets

(56) References Cited

U.S. PATENT DOCUMENTS

| | | | | |
|---|---|---|---|---|
| 2016/0060960 | A1* | 3/2016 | Parkin | E21B 17/10 175/24 |
| 2017/0204671 | A1* | 7/2017 | Laing | E21B 17/1014 |
| 2017/0234071 | A1* | 8/2017 | Spatz | E21B 10/567 175/61 |

* cited by examiner

DOWNHOLE ADJUSTABLE DRILL BITS

TECHNICAL FIELD

The present description relates in general to wellbore drilling and more particularly to, for example, without limitation, downhole configurable drill bits.

BACKGROUND OF THE DISCLOSURE

In the oil and gas industry, wellbores are commonly drilled to intercept and penetrate particular subterranean formations to enable the efficient extraction of embedded hydrocarbons. To reach desired subterranean formations, it is often required to undertake directional drilling, which entails intentional drilling a deviation from a vertical wellbore path. Directionally drilled wellbores can include portions that are vertical, curved, horizontal, and portions that generally extend laterally at any angle from the vertical wellbore portions.

Drill bit design plays an important role in the ability of a drilling assembly to drill the various portions of a wellbore accurately. How the drill bit is configured, for example, directly affects the rate of penetration (ROP) for a drilling assembly and its steerability in terms of being able to generate the required dogleg severity (DLS). Drill bit design also affects the control of wellbore tortuosity and the ability to maintain a stable force balance on the drill bit. Lastly, drill bit design can also affect durability in terms of how long the drill bit can operate before having to be replaced due to wear.

Conventional drilling typically utilizes drill bits designed and otherwise optimized for drilling specific portions of a wellbore. Drill bits with long and minimal undergauge diameter gauge pads, as well as with less active side cutters, for example, are desired for drilling straight wellbore portions since longer and minimal undergauge diameter gauge pads in addition to less active side cutters, provide stability to the drill bit and reduce drill bit walk. Drill bits with short and more undergauge diameter gauge pads, as well as with more active side cutters, however, are desired for drilling curved portions of the wellbore since shorter and more undergauge diameter gauge pads, in addition to more active side cutters, increase steerability. For most well plans, drill bits need to be changed out to drill different portions of the wellbore and thereby ensure the proper drill bit is used to drill the corresponding directional portion (i.e., vertical, curved, lateral, etc.). This requires the drilling assembly to be "tripped out" for different portions of the wellbore. Tripping out a drilling assembly entails pulling the drill pipe, bottom hole assembly (BHA), and corresponding drill bit out of the wellbore, replacing the drill bit with another drill bit having a desired bit design, and then running the drill pipe, BHA, and new drill bit back downhole to drill the next section of the well plan. As can be appreciated, this process requires time and significant cost.

The description provided in the background section should not be assumed to be prior art merely because it is mentioned in or associated with the background section. The background section may include information that describes one or more aspects of the subject technology.

Figure 1:
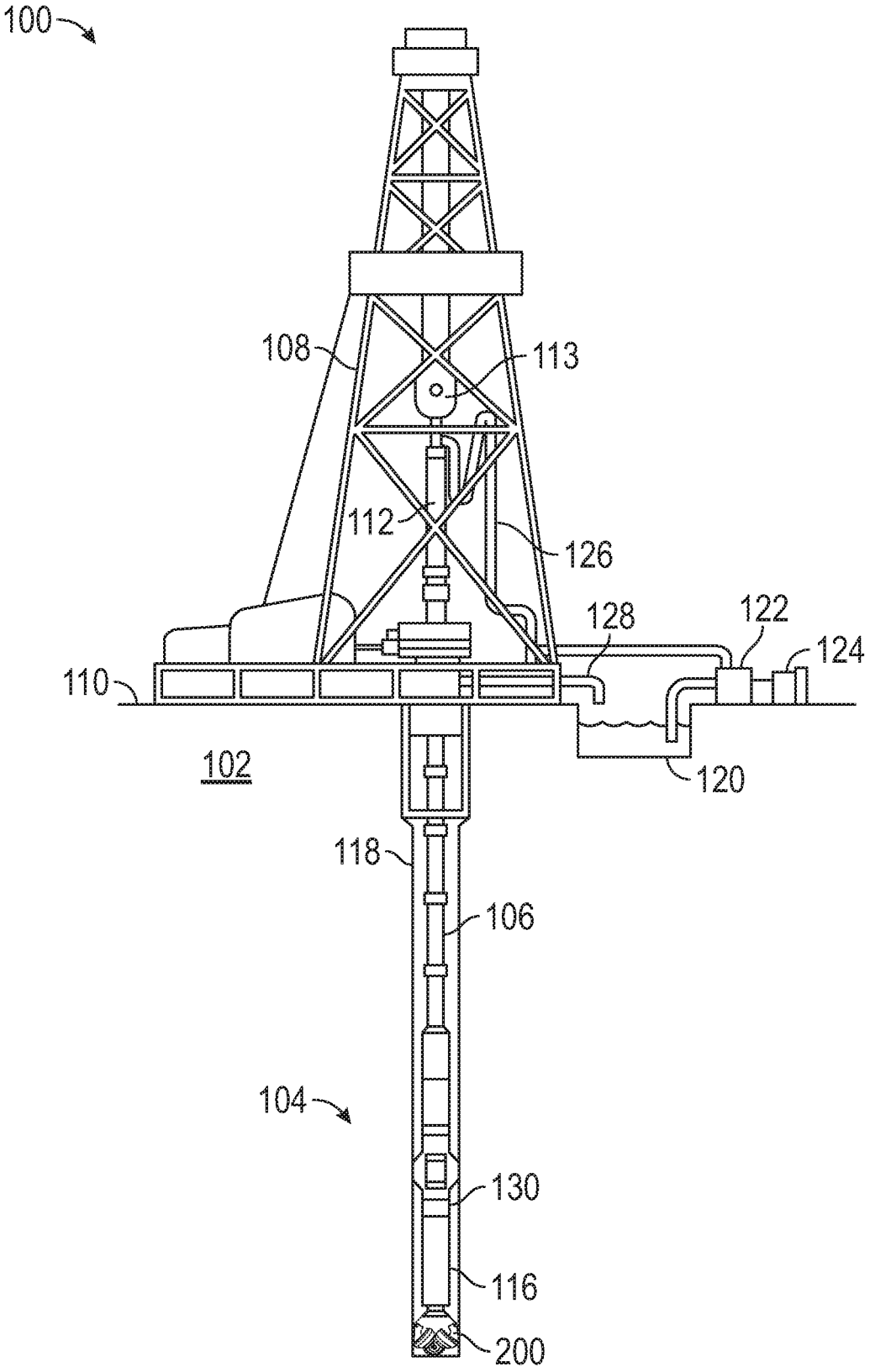
FIG. 1 is a drilling system according to some embodiments of the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present disclosure is related to wellbore drilling and, more specifically, to drill bit designs that allow a well operator to modify drill bit characteristics downhole in real time to facilitate monobore drilling.

Bit design plays an important role in the ability of the bottom hole assembly (BHA) to be able to drill the various sections of a well bore. How the bit is configured directly affects rate of penetration (ROP), steerability (i.e., ability to generate the required dogleg severity (DLS)), controlling well bore tortuosity, stability (i.e., maintaining a stable force balance on the bit), and durability (i.e., how long the bit can operate before having to be replaced due to wear).

Conventional drilling has typically utilized bits optimized for each section or combination of sections of the well bore, which requires tripping out of the hole to change the bit. According to at least some embodiments disclosed herein is the realization that a bit that is adjustable while down hole could be utilized to drill multiple well bore sections in a single bit run, thereby avoiding many of the drawbacks of conventional drilling. One such application is the combining of the vertical, curve, lateral (VCL) or monobore in one run. There is increasing need to have the ability to perform VCL in one run to optimize cost and save rig time during drilling.

Additionally, according to at least some embodiments disclosed herein is the realization that bits with less aggressive side cutting ability and minimal under-gauge diameter gauge pads are desired for drilling straight sections because they provide stability to the bit and reduce bit walk. However, for the curve section of the well, more aggressive side cutting ability and more under-gauge diameter gauge pads are desired to increase steerability. For most well plans, bits need to be changed for different sections of the well plan. This involves tripping the BHA out of hole, changing the bit at the surface and trip in again to drill the desired section of the well plan.

An aspect of some embodiments disclosed herein includes an ability to change the gauge pad diameter and axial position downhole dynamically through use of a single actuator and associated movable cutters and gauge pad set. An aspect of drill bits disclosed herein also includes an ability to change the side-cutting efficiency by changing the active cutter diameter and axial position downhole dynamically through use of a single actuator and associated movable cutters and gauge pad set. Drill bits disclosed herein can facilitate monobore drilling or vertical, curve and lateral drilling in one run. Drill bits disclosed herein can include sensors with automated controls used to adjust the position of the movable active cutters and gauge pad set in order to improve steerability, improve stability, and optimize the well bore profile and drilling performance.

Drill bits according to some embodiments of the present disclosure can be deployed downhole with the ability to extend, via a single actuator, the single set of movable cutters and gauge pads, which can include one or more gauge pads per blade at any given time.

Accordingly, some embodiments of the drill bits disclosed herein can permit modification of the gauge pad and active cutter characteristics in real time downhole for different sections of the well plan to obtain a desired BHA stability versus steerability trade-off for any given section of the well plan. Furthermore, the side-cutting efficiency can be modified real-time downhole by modifying the diameter and axial position of the gauge pads and active cutters.

FIG. 1 is a schematic diagram of an exemplary drilling system 100 that can employ one or more principles of the present disclosure. Boreholes can be created by drilling into the earth 102 using the drilling system 100. The drilling system 100 can be configured to drive a bottom hole assembly (BHA) 104 positioned or otherwise arranged at the bottom of a drill string 106 extended into the earth 102 from a derrick 108 arranged at the surface 110. The derrick 108 includes a kelly 112, a traveling block 113, a hook 114, and swivel 115 which are used to lower and raise the kelly 112 and the drill string 106. The kelly is rotated by the kelly bushing 117. A top drive system can be used in place of the kelly and kelly bushing to rotate the drill string.

The BHA 104 can include a drill bit 200 operatively coupled to a directional steering tool 116 which can be moved axially within a drilled wellbore 118 as attached to the drill string 106. During operation, the drill bit 200 penetrates the earth 102 and thereby creates the wellbore 118. The directional steering tool 116 provides directional control of the drill bit 200 as it advances into the earth 102. The BHA 104 can include various measurement tools such as, but not limited to, measurement-while-drilling (MWD) and logging-while-drilling (LWD) tools, that can be configured to take downhole measurements of drilling conditions. Example sensors that can be included in the MWD or LWD tools include, but are not limited to, a temperature sensor, a pressure sensor, a strain gauge or sensor, a chemical composition sensor, an inclination sensor, a gamma ray sensor, an azimuth sensor, a rotations-per-minute (rpm) sensor, a weight-on-bit sensor, a torque-on-bit sensor, an axial sensor, a torsional sensor, a lateral vibration sensor, a sonic emitter and receiver, a resistivity sensors, a sonic or acoustic sensor, a nuclear magnetic resonance logging sensor, and the like.

Fluid or "mud" from a mud tank 120 can be pumped downhole using a mud pump 122 powered by an adjacent power source, such as a prime mover or motor 124. The mud can be pumped from the mud tank 120, through a stand pipe 126, which feeds the mud into the drill string 106 and conveys the same to the drill bit 200. The mud exits one or more nozzles arranged in the drill bit 200 and in the process cools the drill bit 200. After exiting the drill bit 200, the mud circulates back to the surface 110 via the annulus defined between the wellbore 118 and the drill string 106, and in the process returns drill cuttings and debris to the surface. The cuttings and mud mixture are passed through a flow line 128 and are processed such that a cleaned mud is returned down hole through the stand pipe 126 once again.

Although the drilling system 100 is shown and described with respect to a rotary drill system, many types of drilling systems can be employed in carrying out embodiments of the disclosure. For instance, drills and drill rigs used in embodiments of the disclosure can be used onshore (as depicted in FIG. 1) or offshore (not shown). Offshore oil rigs that can be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to drilling oil and gas wells, various embodiments of the disclosure can be used in many other applications. For example, disclosed methods can be used in drilling for mineral exploration, environmental investigation, natural gas extraction, underground installation, mining operations, water wells, geothermal wells, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
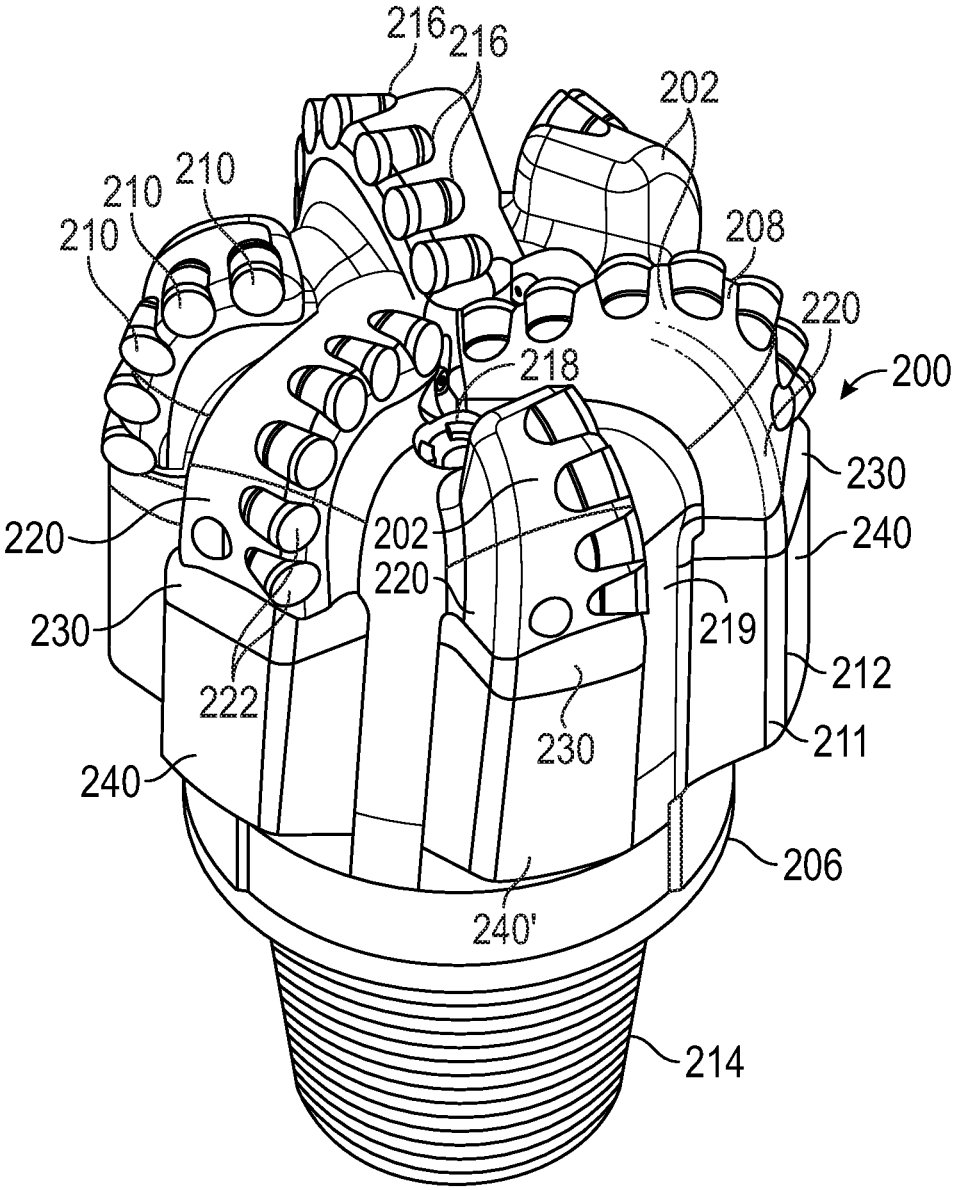
FIG. 2 is a perspective view of a drill bit according to some embodiments of the present disclosure.

FIG. 2 is a perspective view of an example embodiment of the drill bit 200 that can be fabricated in accordance with the principles of the present disclosure. The drill bit 200 is generally depicted in FIG. 2 as a fixed-cutter drill bit that can be used in the oil and gas industry to drill wellbores. It will be recognized that the subject technology can be applicable to other types of drill bits, such as roller cone bits. As illustrated, the drill bit 200 can provide fixed cutter blades 202 with fixed cutting elements 210 angularly spaced from each other about the circumference of a bit head 204. The bit head 204 is connected to a shank 206. The shank 206 can be connected to the bit head 204 by welding or integral to the bit head. The shank 206 can further include a threaded pin 214, such as an American Petroleum Institute (API) drill pipe thread used to connect the drill bit 200 to the directional steering tool 116 (FIG. 1).

In the depicted example, the drill bit 200 includes a substrate 208 of the blade in which multiple recesses or pockets 216 are formed. The substrate 208 of the blades can be formed of a variety of hard or ultra-hard materials including, but not limited to, steel, steel alloys, tungsten carbide, cemented carbide, and any derivatives and combinations thereof. Suitable cemented carbides can contain varying proportions of titanium carbide (TiC), tantalum carbide (TaC), and niobium carbide (NbC). Additionally, various binding metals can be included in the substrate 208 of the blades, such as cobalt, nickel, iron, metal alloys, or mixtures thereof. In the substrate 208 of the blades, the metal carbide grains are supported within a metallic binder, such as cobalt. In other cases, the substrate 208 of the blades can be formed of a sintered tungsten carbide composite structure or a diamond ultra-hard material, such as polycrystalline diamond or thermally stable polycrystalline diamond (TSP).

A fixed cutting element 210 (alternately referred to as a "cutter") can be fixedly installed within each pocket 216. This can be done, for example, by brazing each cutting element 210 into a corresponding pocket 216. As the drill bit 200 is rotated in use, the cutting elements 210 engage the rock and underlying earthen materials, to dig, scrape or grind away the material of the formation being penetrated. The fixed cutting elements 210 can be made of a variety of ultra-hard materials including, but not limited to, polycrystalline diamond (PCD), thermally stable polycrystalline diamond (TSP), cubic boron nitride, impregnated diamond, nanocrystalline diamond, ultra-nanocrystalline diamond, and zirconia. Such materials are very hard-wearing and are suitable for use in bearing surfaces as herein described.

While the illustrated embodiments show the fixed cutting elements 210 and the substrate 208 of the blades as two distinct components of the drill bit 200, those skilled in the art will readily appreciate that the fixed cutting elements 210 and the substrate 208 can alternatively be integrally formed and otherwise made of the same materials, without departing from the scope of the disclosure.

In addition to fixed cutter blades 202 with fixed cutting elements 210, the drill bit 200 can include adjustable cutter blades 220. The fixed cutter blades 202 can be angularly spaced from each other about the circumference of a bit head 204. Each of the fixed cutter blades 202 can include one or more adjustable cutting elements 222. Whereas the fixed cutter blades 202 can be positioned at an end of the bit head 204, the adjustable cutter blades 220 can be positioned on sides of the bit head 204.

The drill bit 200 can include gauge pads 240 that are connected to a corresponding one of the adjustable cutter blades 220 by an actuator block 230. The gauge pads 240 can have a shape and size that facilitates trimming or reaming of a sidewall of a wellbore. The gauge pads 240 can include edges which engage sidewalls of the wellbore to remove adjacent formation materials. The position of the adjustable cutter blades 220 and gauge pads 240 can be adjusted during use, as described further herein.

During drilling operations, drilling fluid or "mud" can be pumped downhole through the drill string 106 (FIG. 1) coupled to the drill bit 200 at the threaded pin 214. The drilling fluid circulates through and out of the drill bit 200 at one or more nozzles 218 positioned in nozzle openings defined in the bit head 204. Junk slots 219 are formed between each angularly adjacent pair of cutter blades 202. Cuttings, downhole debris, formation fluids, drilling fluid, etc., can pass through the junk slots 219 and circulate back to the well surface within an annulus formed between exterior portions of the drill string and the inner wall of the wellbore being drilled.

Figure 3:
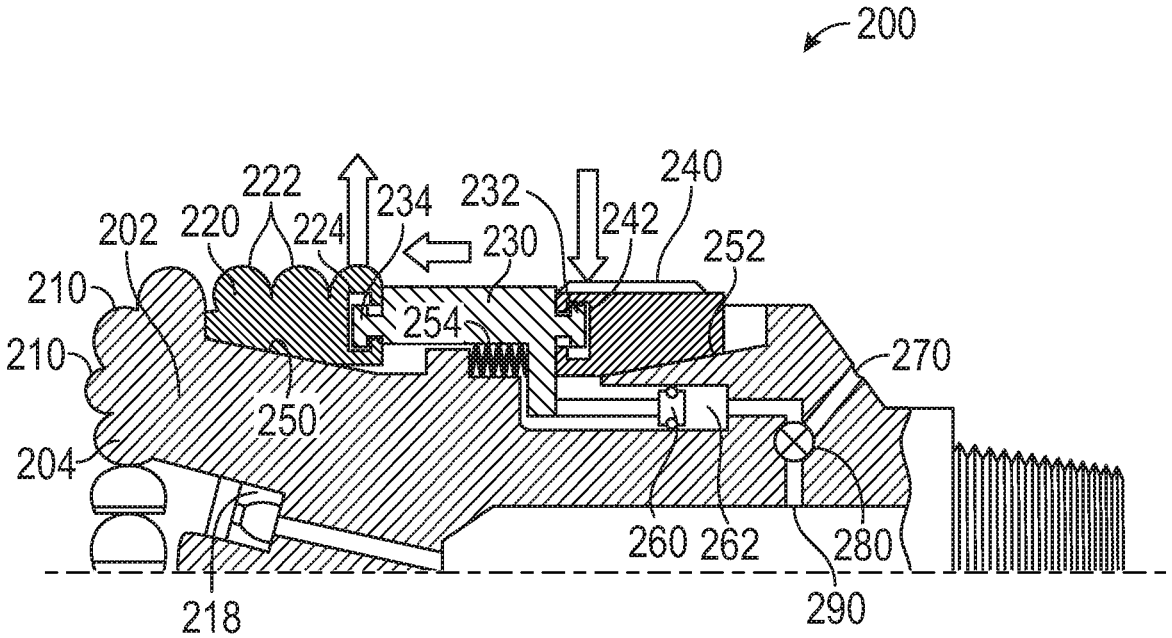
FIG. 3 is a sectional view of a drill bit according to some embodiments of the present disclosure.
Figure 4:
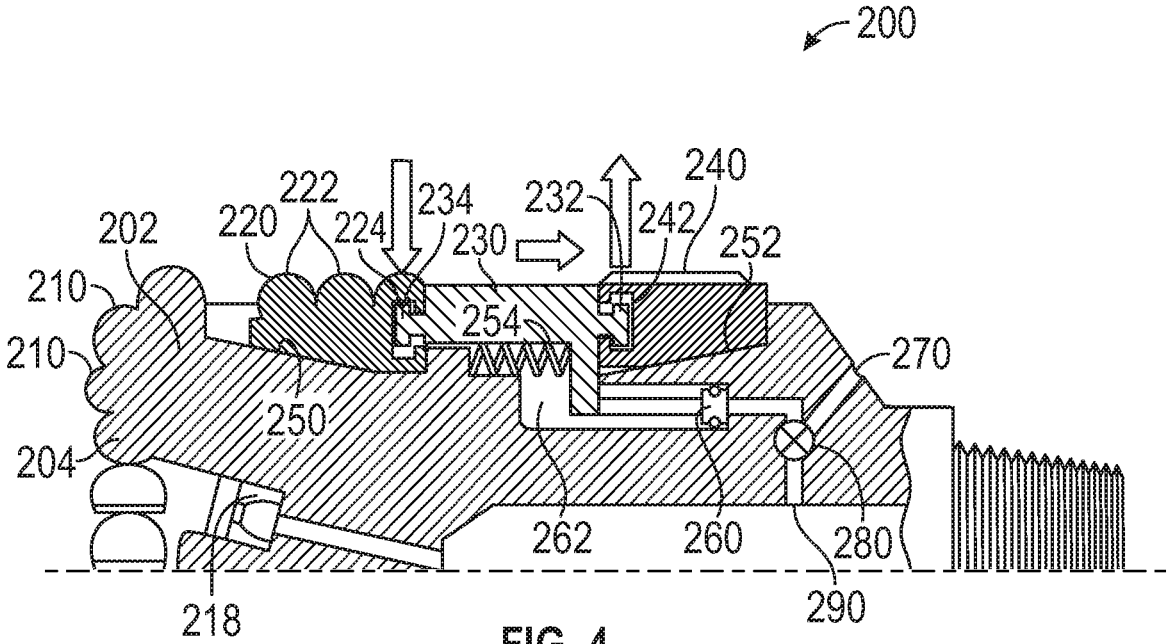
FIG. 4 is another sectional view of the drill bit of FIG. 3 according to some embodiments of the present disclosure.

According to some embodiments, for example as shown in FIGS. 3 and 4, the adjustable cutter blade 220 and the gauge pad 240 can be moved during operation to provide adjustable performance characteristics.

As shown in FIG. 3, the drill bit 200 can have a first configuration (i.e., an improved steerability configuration) in which the adjustable cutter blade 220 is extended radially outwardly and the gauge pad 240 is retracted radially inwardly. In this configuration, the adjustable cutter blades 220 are positioned to be axially down and radially outward at the gauge diameter which provides a more aggressive side cutting ability as the active cutter profile is shorter and more adjustable cutting elements 222 engage the formation at the gauge diameter. Additionally, the gauge pads 240 are positioned to be axially down and radially inward below the gauge diameter which allows the bit to aggressively side cut without the gauge pads 240 acting as a "bumper" and interfering with the side cutting action in the higher DLS profile of the curved well bore.

As shown in FIG. 4, the drill bit 200 can have a second configuration (i.e., an improved stability configuration) in which the adjustable cutter blade 220 is retracted radially inwardly and the gauge pad 240 is extended radially outwardly. In this configuration, the adjustable cutter blades 220 are positioned to be axially up and radially inward below the gauge diameter which provides a less aggressive side cutting ability as the active cutter profile is longer and fewer adjustable cutting elements 222 engage the formation at the gauge diameter. Additionally, the gauge pads 240 are positioned to be axially up and radially outward at or near the gauge diameter, which provides more stability of the bit.

The bit head 204 can include a blade ramp 250 that supports the adjustable cutter blade 220. The blade ramp 250 can define a surface that extends at an angle with respect to a longitudinal axis of the bit head 204. The blade ramp 250 can be planar or another shape that is complementary to a shape of the adjustable cutter blade 220 resting on the blade ramp 250. When the adjustable cutter blade 220 is moved along the blade ramp 250, the blade ramp 250 can urge the adjustable cutter blade 220 to a radial position corresponding to the axial position of the adjustable cutter blade 220. An angle of the blade ramp 250 can be selected based on desired radial force, available pressure ring area, bit differential pressure, material coefficient of friction, return bias spring force, and/or other factors. For example, as shown in FIG. 3, when the adjustable cutter blade 220 is moved axially toward to the fixed cutter blades 202, the blade ramp 250 urges the adjustable cutter blade 220 to extend radially outwardly. Additionally, as shown in FIG. 4, when the adjustable cutter blade 220 is moved axially away from the fixed cutter blades 202, the blade ramp 250 allows the adjustable cutter blade 220 to retract radially inwardly. The range of radial extension/retraction for the cutter blade 220 and gauge pad 240 can be less than 0.1", for example about 0.063" or less. The radial rate for the cutter blade 220 and the gauge pad 240 can be the same or different depending on application requirements.

The bit head 204 can further include a gauge pad ramp 252 that supports the gauge pad 240. The gauge pad ramp 252 can define a surface that extends at an angle with respect to the longitudinal axis of the bit head 204. The gauge pad ramp 252 can be planar or another shape that is complementary to a shape of the gauge pad 240 resting on the gauge pad ramp 252. When the adjustable gauge pad 240 is moved along the gauge pad ramp 252, the gauge pad ramp 252 can urge the adjustable gauge pad 240 to a radial position corresponding to the axial position of the gauge pad 240. For example, as shown in FIG. 3, when the gauge pad 240 is moved axially toward the fixed cutter blades 202, the gauge pad ramp 252 allows the gauge pad 240 to retract radially inwardly. Additionally, as shown in FIG. 4, when the gauge pad 240 is moved axially away from the fixed cutter blades 202, the gauge pad ramp 252 urges the gauge pad 240 to extend radially outwardly.

The adjustable cutter blade 220 and the gauge pad 240 can be moved axially based on a position and axial movement of the actuator block 230. As the actuator block 230 moves axially, the adjustable cutter blade 220 and the gauge pad 240 can move in a same axial direction and extent, along with accompanying radial movement as described herein. The actuator block 230 can move as directed by a pressure ring 260 coupled to the actuator block 230. The pressure ring 260 can reside within a pressure chamber 262. The pressure ring 260 can include seals that engage the walls of the pressure chamber 262, such that a pressure differential within the pressure chamber 262 and across the pressure ring 260 can drive the pressure ring 260 within the pressure chamber 262. The single actuator pressure ring is driven by the pressure differential between the higher bore pressure and lower annulus pressure. Movement of the pressure ring 260 can be translated to axial movement of the actuator block 230, as well as axial and radial movement of the adjustable cutter blade 220 and the gauge pad 240. The actuator block 230 can be biased in an axial direction, for example by a spring element 254. The spring element 254 can reside between a portion of the bit head 204 and a portion of the actuator block 230. The spring element 254 can be arranged so that it applies a force to the actuator block 230 that is in opposition to a force on a side of the pressure ring 260 that is opposite the actuator block 230. The actuator block 230 is pushed axially up by the spring element 254 when pressure acting on the single actuator pressure ring is relieved to the annulus. The angles of the blade ramps 250 and gauge pad ramps 252 can be optimized to balance the available actuation force and the competing forces from the spring element 254 and loads on the adjustable cutter blades 220 and the gauge pads 240.

The actuator block 230 can be coupled to each of the adjustable cutter blades 220 and the gauge pads 240 to maintain a fixed axial position relative to each of the adjustable cutter blades 220 and the gauge pads 240. For example, the actuator block 230 can include a first connector 234 and a second connector 232. The first connector 234 can reside within a first receptacle 224 of the adjustable cutter blade 220. The second connector 232 can reside within a second receptacle 242 of the gauge pad 240. The arrangement of connectors and receptacles can be altered so that one or more connectors are located on the actuator block 230 and a receptacle can be located on the adjustable cutter blade 220 and/or the gauge pad 240.

The actuator block 230 can be coupled to each of the adjustable cutter blades 220 and the gauge pads 240 to facilitate various radial positions relative to each of the adjustable cutter blades 220 and the gauge pads 240. For example, the first receptacle 224 can have a radial dimension that is larger than a radial dimension of the first connector 234, so that the first connector 234 can move radially within the first receptacle 224 while the adjustable cutter blade 220 moves radially relative to the actuator block 230. By further example, the second receptacle 242 can have a radial dimension that is larger than a radial dimension of the second connector 232, so that the second connector 232 can move radially within the second receptacle 242 while the gauge pad 240 moves radially relative to the actuator block 230.

The actuator block 230 can be actuated based on pressure conditions within the pressure chamber 262 and applied to the pressure ring 260. The pressure chamber 262 can be in fluid communication with either an annulus port 270 or a bore port 290. The bore port 290 can connect to a bore that supplies fluid to the nozzle 218 of the drill bit 200. The pressure in the bore and at the bore port 290 can be relatively high to drive drilling fluid to the nozzle 218. The annulus port 270 can connect to an external environment, such as the annulus in which the drill bit 200 is operating. The pressure in the annulus and at the annulus port 270 can be relatively low, compared to the pressure in the bore and at the bore port 290. A valve 280 can control whether the pressure chamber 262 is in fluid communication with the annulus port 270 or the bore port 290 or closed to both ports 270 and 290. As used herein, "fluid communication" can refer to greater access to one region that to another region, such that pressure conditions of the one region has greater influence that does the other region.

Figure 5:
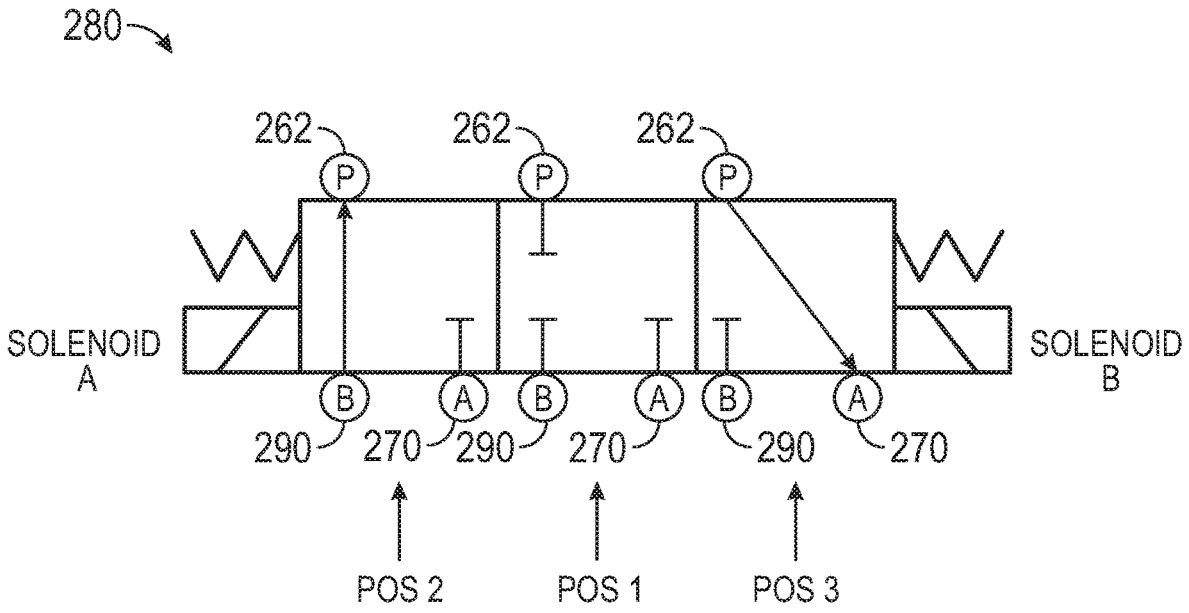
FIG. 5 is schematic diagram showing positions of a valve according to some embodiments of the present disclosure.

As shown in FIG. 5, the valve 280 can be a three-way valve having three possible positions. The valve 280 can include two or more solenoids to provide the three possible positions. Other valve and solenoid combinations are contemplated to provide operation, for example, without requiring continuous electrical power.

In a first position, the pressure chamber 262 can be isolated from both the annulus port 270 and the bore port 290. In the first position, solenoid valves of the valve 280 can be deactivated or non-powered.

In a second position (improved steerability mode), the valve 280 can allow the pressure chamber 262 to be in fluid communication with the bore port 290, such that the high pressure of the bore is communicated to the pressure ring 260. With the valve 280 in the second position, the actuator block 230 will drive the adjustable cutter blade 220 and the gauge pad 240 in a first axial direction (e.g., toward the fixed cutter blades 202) with corresponding radial adjustments of the adjustable cutter blade 220 and the gauge pad 240, as described herein.

In a third position (improved stability mode), the valve 280 can allow the pressure chamber 262 to be in fluid communication with the annulus port 270, such that the higher pressure of the pressure chamber 262 is communicated to the annulus 270. With the valve 280 in the third position, the actuator block 230 will drive the adjustable cutter blade 220 and the gauge pad 240 in a second axial direction (e.g., away from the fixed cutter blades 202) with corresponding radial adjustments of the adjustable cutter blade 220 and the gauge pad 240, as described herein.

Figure 6:
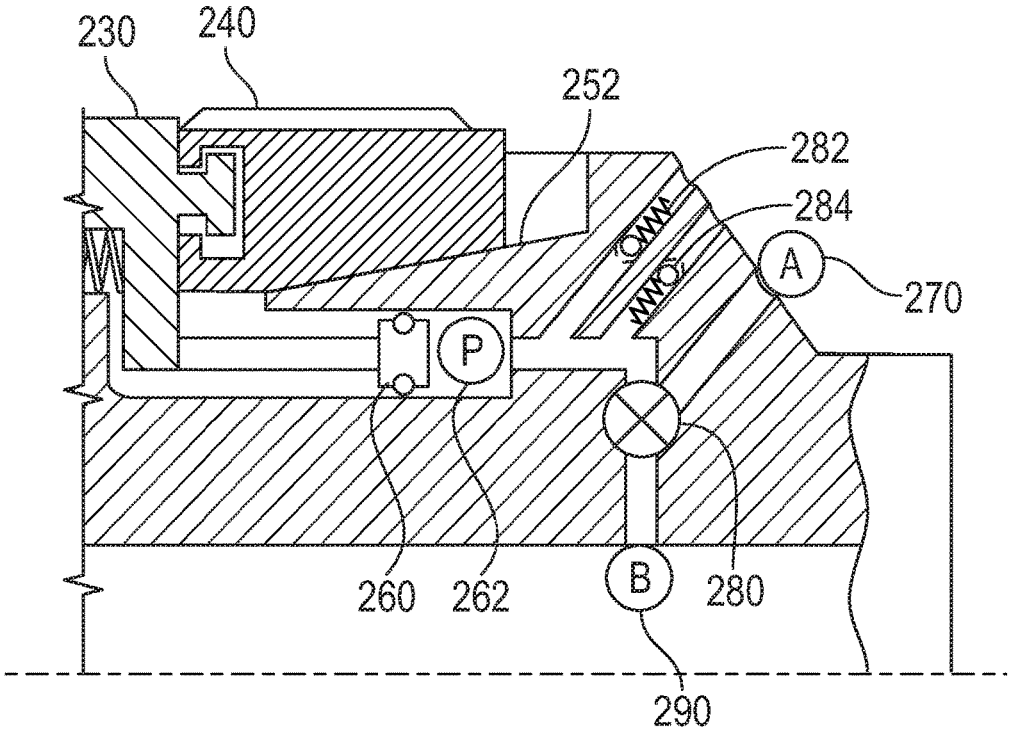
FIG. 6 is another sectional view of the drill bit of FIG. 3 according to some embodiments of the present disclosure.

According to some embodiments, for example as shown in FIG. 6, pressure relief valves can be provided in fluid communication with the pressure chamber 262 and the pressure ring 260. At surface, the trapped volume between the valve 280 and the pressure ring 260 can be at atmospheric pressure. As the drill bit 200 is tripped in the well bore, the hydrostatic pressure of the fluid in the well bore increases with depth, and the trip in relief valve 284 allows the trapped volume to equalize with the hydrostatic pressure. After reaching maximum depth, the trapped volume is at the hydrostatic pressure plus the additional pressure rating of the trip out relief valve 282. This pressure can be very high, and this high pressure must be relieved via the trip out relief valve 282 as the tool is being tripped of the well bore. The trip out relief valve 282 can have sufficient cracking pressure rating to withstand the pressure differential between the bore and annulus during drilling. The trip out relief valve 282 can have a cracking pressure that is greater than a cracking pressure of the trip in relief valve 284. At surface it is recommended that the valve 280 be cycled to the third position (i.e., allowing the pressure chamber 262 to be in fluid communication with the annulus port 270) to relieve cracking pressure of the trip out relief valve 282 in the trapped volume.

Automated controls can be used to adjust the position of the adjustable cutter blades 220 and the gauge pads 240 in order to enhance steering the bit as well as controlling stability of the bit. Positional guidance sensors, including for example accelerometers, magnetometers, gyroscopes, and the like, can be used to configure the drill bit 200 to assist a directional steering tool with guiding the drill bit 200 with respect to a well plan. The automated controls can perform downhole processing or work in conjunction with surface automated controls, via uplink/downlink telemetry to automatically adjust the bit configuration. Manual controls can also be communicated to the bit via uplink/downlink telemetry to control the bit configuration.

Figure 7A:
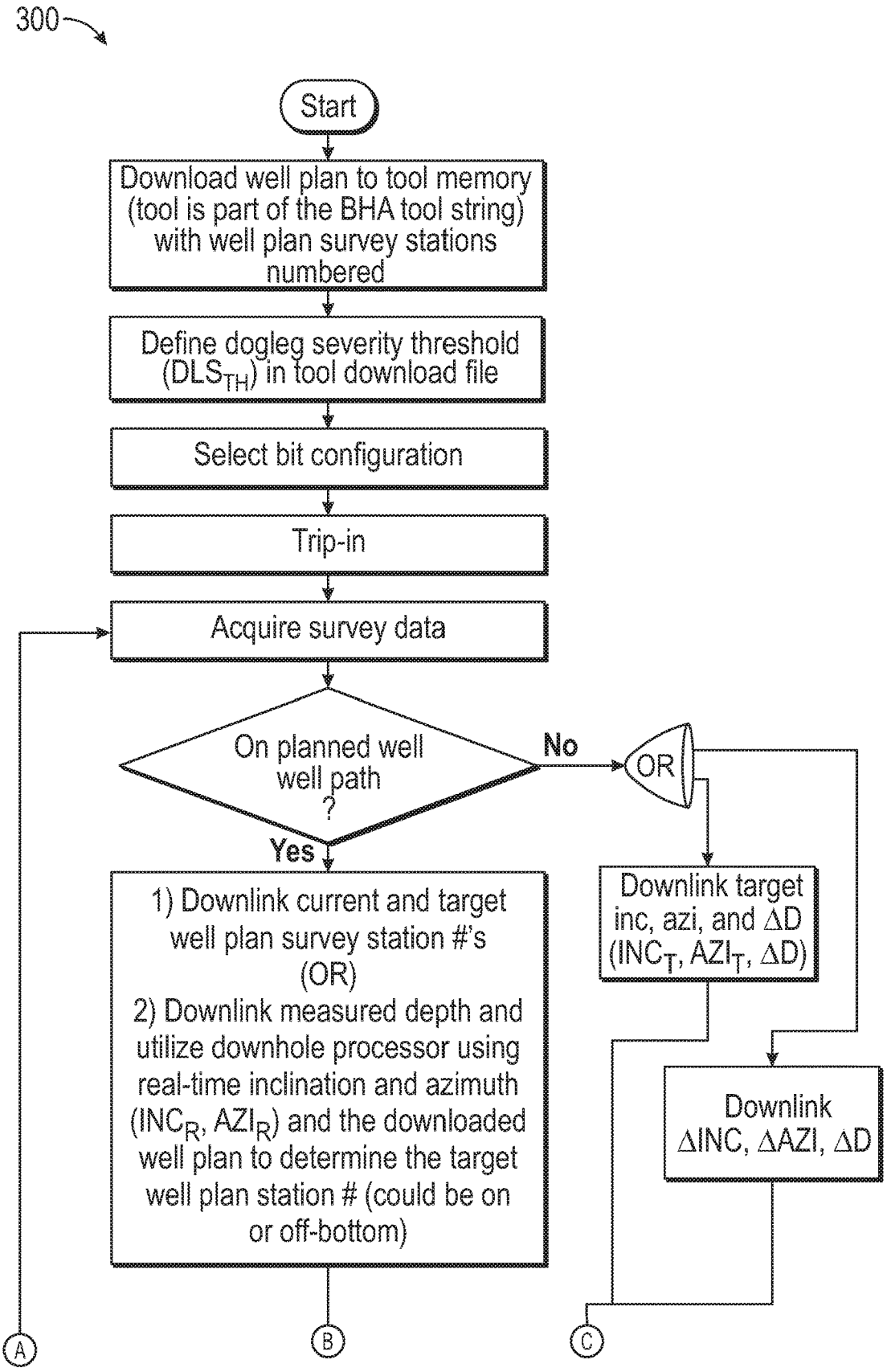
FIGS. 7A and 7B is a flow chart according to some embodiments of the present disclosure.
Figure 7B:
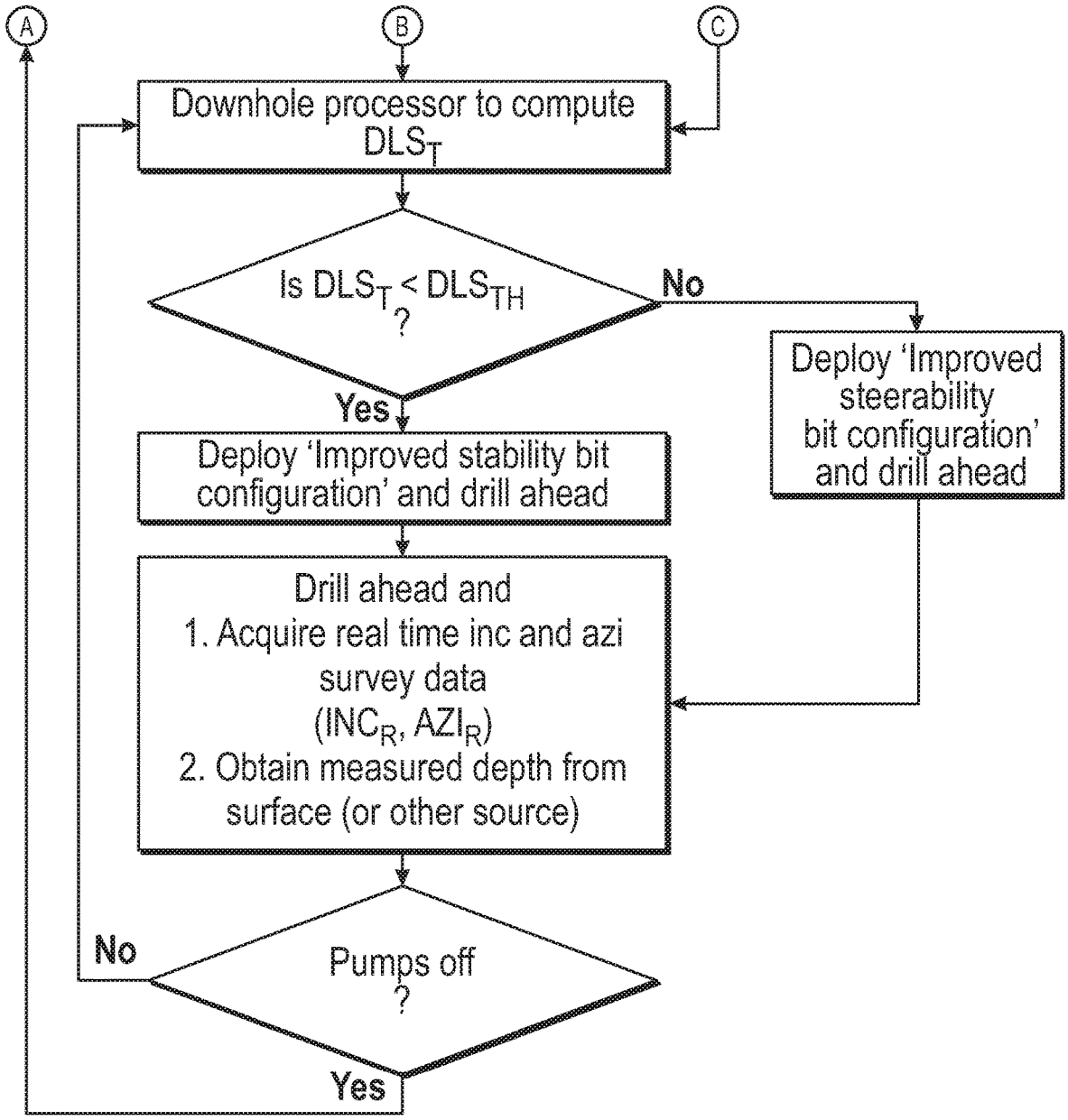

As shown in FIGS. 7A and 7B, a process 300 can be performed to control the drill bit 200. The process can allow the system to continuously compute the required dogleg severity and compare the required dogleg severity to threshold values for dogleg severity. Dogleg severity (DLS) is a measure of the amount of change in inclination and/or direction (azimuth) of a borehole, usually expressed in degrees per 100 feet of course length. By monitoring the required dogleg severity, the bit can automatically adjust between an improved steerability configuration and an improved stability configuration as needed to optimize the well bore profile and drilling performance. In practice, the process 300 can include all or only some of the operations illustrated, as well as additional operations.

A well plan includes (N+1) number of survey stations (e.g., 0, 1, 2, . . . N). The survey stations measure inclination ("Inc"), azimuth ("Azi"), and measured depth, as well as other parameters. The survey data can include, but is not limited to, survey measurements that are stationary, rotating, intermittent, and continuous. With respect to FIGS. 7A and 7B, the following notations are referenced:

WPSS=Well Plan Survey Station

Drill String Measured Depth=Depth based on pipe tally at surface or real time downhole estimate $DLS_{TH}$=Dogleg severity threshold value. Below the threshold, the bit can be configured in "improved stability" mode. Above or equal to the threshold the bit can be configured in "improved steerability" mode.

$DLS_T$=Target dogleg Severity required to reach target inclination and azimuth over a measured depth distance of ΔD.

$INC_T$=Target inclination (inclination value corresponding to target well plan survey station # or downlinked target inclination). This value is at a measured depth ΔD from the latest survey measured depth.

$AZI_T$=Target azimuth (azimuth value corresponding to target well plan survey station # or downlinked target azimuth). This value is at a measured depth ΔD from the latest survey measured depth.

$INC_R$=Real-time inclination value from survey data measured by downhole sensor.

$AZI_R$=Real-time azimuth value from survey data measured by down hole sensor.

ΔD=Change in measured depth between latest measured survey values and target values for inclination and azimuth. ΔD applies to ΔINC, ΔAZI, $DLS_T$.

A well plan can be downloaded to a memory of a tool (e.g., the directional steering tool 116). Well plan survey stations can be numbered within the well plan. Thresholds for dogleg severity ($DLS_{TH}$) can be defined. ΔD is the change in measured depth between measured survey values and target values for inclination and azimuth and is used to compute the required target dogleg severity ($DLS_T$). $DLS_T$ is the required target dogleg severity to achieve both the required change in inclination and change in azimuth over a measured depth distance of ΔD. The required change in inclination is inclination change between $INC_R$ and $INC_T$. The required change in azimuth is the azimuth change between $AZI_R$ and $AZI_T$. After the drill bit is tripped in, a reference Well Plan Survey Station (WPSS) number can be determined which provides a reference with respect to the well plan and current location of the bit in the well plan. Survey data is acquired to determine real time inclination ($INC_R$) and azimuth ($AZI_R$).

During drilling, real time inclination ($INC_R$) and azimuth ($AZI_R$) data is acquired. Knowing the real time inclination ($INC_R$) and azimuth ($AZI_R$), a target value for inclination $INC_T$, and a target value for azimuth $AZI_T$ are determined. $INC_T$ and $AZI_T$ can be target values, corresponding to the next well plan survey station, if the well is on plan. If the well is not on plan, $INC_T$, $AZI_T$, and ΔD can be downlinked to steer the well as required. As an option, ΔINC, ΔAZI, and ΔD can be downlinked as direct input (i.e. non-computed values). Knowing $INC_R$, $AZI_R$, $INC_T$, $AZI_T$, and ΔD, the downhole processor can compute $DLS_T$. If $DLS_T > DLS_{TH}$, then a configuration with improved steerabilty is applied to the drill bit, as described herein. If $DLS_T < DLS_{TH}$, then a configuration with improved stability is applied to the drill bit, as described herein. An example of this logic is the following: A well is currently at a measured depth of 7500' with an inclination ($INC_R$) of 30° and an azimuth ($AZI_R$) of 330°. A revised well plan calls for maintaining the current azimuth but requires the well to be at in at an inclination of 45° within a measured depth of 200'. Therefore, $INC_T$=45°, $AZI_T$=330°, and ΔD=200'. The target now requires an inclination increase of 15° with no change in azimuth over the next 200' of measured depth, which corresponds to a build of 7.5°/100' with no turn. Therefore, the total $DLS_T$=7.5°/100'. The $DLS_{TH}$ has been set at 2°/100', so $DLS_T > DLS_{TH}$ and the bit will be configured for improved steerability mode. Later in the well, at the end of curve, the plan calls for keeping the well horizontal at the same 330° azimith. The well is on plan at an inclination of 90° and azimuth of 330° so the ΔINC and ΔAZI will be zero going forward over the next ΔD increment of measured depth, which results in a required target dogleg severity ($DLS_T$) of 0°/100', which is less than dogleg severity threshold ($DLS_{TH}$) of 2°, so the improved stability mode is selected.

Various examples of aspects of the disclosure are described below as clauses for convenience. These are provided as examples, and do not limit the subject technology.

Clause A. A drill bit comprising: a bit head defining a longitudinal axis; an adjustable cutter blade comprising a cutting element; a blade ramp extending transversely relative to the longitudinal axis and arranged to radially adjust the adjustable cutter blade when the adjustable cutter blade moves axially along a side of the bit head; a gauge pad coupled to the adjustable cutter blade; and a gauge pad ramp extending transversely relative to the longitudinal axis and arranged to radially adjust the gauge pad when the gauge pad moves axially along the side of the bit head.

Clause B. A drill bit comprising: a bit head; an adjustable cutter blade on a side of the bit head, the adjustable cutter blade comprising a cutting element; and a gauge pad on the side of the bit head; wherein the adjustable cutter blade and the gauge pad are connected, such that, when the adjustable cutter blade and the gauge pad move in a same axial direction, the adjustable cutter blade and the gauge pad move in opposite radial directions.

Clause C. A method of adjusting a characteristic of a drill bit, the method comprising: while operating the drill bit within a wellbore, moving an adjustable cutter blade and a gauge pad in opposite radial directions on a side of a bit head of the drill bit by moving the adjustable cutter blade and the gauge pad in a same axial direction.

Each of embodiments A, B, and C may have one or more of the following additional elements in any combination:

Element 1: wherein the blade ramp has a surface with an orientation that is different from an orientation of the gauge pad ramp.

Element 2: wherein the orientation of the blade ramp extends transversely relative to a gauge pad ramp axial orientation.

Element 3: wherein the blade ramp and the gauge pad ramp each intersect a longitudinal axis of the bit head.

Element 4: an actuator block coupled to the adjustable cutter blade and the gauge pad such that an axial movement of the actuator block results in a corresponding axial movement of the adjustable cutter blade and the gauge pad.

Element 5: wherein the actuator block is biased by a spring element in an axial direction parallel to a longitudinal axis of the bit head.

Element 6: wherein the actuator block is coupled to a pressure ring that is moveable in a pressure chamber within the bit head.

Element 7: a valve that has a first position in which the pressure chamber is isolated from both the bore port of the drill bit and an annulus outside the drill bit, a second position in which the pressure chamber is in fluid communication with a bore port of the drill bit and a third position in which the pressure chamber is in fluid communication with an annulus outside the drill bit.

Element 8: a trip out relief valve between the pressure chamber and an annulus outside the drill bit; and a trip in relief valve between the pressure chamber and the annulus outside the drill bit; wherein the trip out relief valve has a cracking pressure that is greater than a pressure differential, between a bore and the annulus, during drilling.

Element 9: fixed cutter blades comprising fixed cutting elements and positioned adjacent to the adjustable cutter blade.

Element 10: a directional steering tool and the drill bit described above, operatively coupled to the directional steering tool.

Element 11: an actuator block coupled to the adjustable cutter blade and the gauge pad such that the adjustable cutter blade and the gauge pad are axially fixed and radially moveable with respect to the actuator block.

Element 12: wherein the adjustable cutter blade and the gauge pad are moveable in a first axial direction when a first pressure from within the drill bit is applied to a pressure ring coupled to the actuator block, and wherein the adjustable cutter blade and the gauge pad are moveable in a second axial direction, opposite the first axial direction, when a second pressure, lower than the first pressure, from outside the drill bit is applied to a pressure ring coupled to the actuator block.

Element 13: moving the adjustable cutter blade and the gauge pad in opposite radial directions comprises adjusting the adjustable cutter blade to extend radially farther than the gauge pad when a rate of change of a direction of the drill bit is above a threshold.

Element 14: moving the adjustable cutter blade and the gauge pad in opposite radial directions comprises adjusting the gauge pad to extend radially equal to or farther than the adjustable cutter blade when a rate of change of a direction of the drill bit is below a threshold.

Element 15: wherein moving the adjustable cutter blade and the gauge pad in the same axial direction comprises axially moving an actuator block coupled to the adjustable cutter blade and the gauge pad.

Element 16: wherein axially moving an actuator block comprises operating a valve to adjust a pressure on a side of a pressure ring connected to the actuator block.

Element 17: wherein moving the adjustable cutter blade and the gauge pad in opposite radial directions comprises: axially moving the adjustable cutter blade along a blade ramp that radially deflects the adjustable cutter blade; and axially moving the gauge pad along a gauge pad ramp that radially deflects the gauge pad.

Element 18: measuring a current position of the drill bit in a well bore; determining a required change in inclination and azimuth of the drill bit over a determined change in measured depth; determining a required dogleg severity to achieve the required change in inclination and azimuth over a determined change in measured depth; determining whether the required dogleg severity exceeds a threshold; and adjusting a relative radial position of the adjustable cutter blade and the gauge pad based on the determining.

Element 19: when the required dogleg severity exceeds a dogleg severity threshold, extending the adjustable cutter blade radially outwardly with respect to the gauge pad; and when the required dogleg severity does not exceed a dogleg severity threshold, extending the gauge pad radially outwardly with respect to the adjustable cutter blade.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, well bore direction terms, such as may extend upwardly, downwardly, diagonally, or horizontally are with respect to a gravitational frame of reference. More specifically, terms, that are related to the adjustable bit components, such as axially down and axially up refer to movement along the axis of the well bore with down being directed into the well bore and up being directed out of the well bore. More specifically, terms that are related to the adjustable bit components, such as radially inwardly and radially outwardly refer to movement transverse to the axis of the well bore with outwardly increasing the effective diameter of the component and inwardly decreasing the effective diameter of the component.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A drill bit comprising:

a bit head defining a longitudinal axis;

an adjustable cutter blade comprising a cutting element;

a blade ramp positioned on an outer side surface of the bit head, the blade ramp extending transversely relative to the longitudinal axis and arranged to radially adjust the adjustable cutter blade, with respect to the longitudinal axis of the bit head, when the adjustable cutter blade moves axially, with respect to the longitudinal axis of the bit head, along the blade ramp;

a gauge pad coupled to the adjustable cutter blade; and a gauge pad ramp positioned on the outer side surface of the bit head, the gauge ramp extending transversely relative to the longitudinal axis and arranged to radially adjust the gauge pad when the gauge pad moves axially, with respect to the longitudinal axis of the bit head, along the gauge ramp.

2. The drill bit of claim 1, wherein the blade ramp has an orientation that is different from an orientation of the gauge pad ramp.

3. The drill bit of claim 1, wherein the blade ramp and the gauge pad ramp each intersect the longitudinal axis of the bit head.

4. The drill bit of claim 1, further comprising an actuator block coupled to the adjustable cutter blade and the gauge pad such that axial movement of the actuator block, with respect to the longitudinal axis of the bit head, results in a corresponding axial movement of the adjustable cutter blade and the gauge pad, with respect to the longitudinal axis of the bit head.

5. The drill bit of claim 4, wherein the actuator block is biased by a spring element in an axial direction parallel to the longitudinal axis of the bit head.

6. The drill bit of claim 4, wherein the actuator block is coupled to a pressure ring that is moveable in a pressure chamber within the bit head.

7. The drill bit of claim 6, further comprising a valve that has a first position in which the pressure chamber is isolated from both a bore port of the drill bit and an annulus outside the drill bit, a second position in which the pressure chamber is in fluid communication with the bore port of the drill bit and a third position in which the pressure chamber is in fluid communication with the annulus outside the drill bit.

8. The drill bit of claim 7, further comprising:

a trip out relief valve between the pressure chamber and the annulus outside the drill bit; and a trip in relief valve between the pressure chamber and the annulus outside the drill bit;

wherein the trip out relief valve has a cracking pressure that is greater than a pressure differential, between the bore port and the annulus, during drilling.

9. The drill bit of claim 1, further comprising fixed cutter blades comprising fixed cutting elements and positioned adjacent to the adjustable cutter blade.

10. A bottom hole assembly comprising:

a directional steering tool; and the drill bit of claim 1, operatively coupled to the directional steering tool.

11. A drill bit comprising:

a bit head defining a longitudinal axis;

an adjustable cutter blade on a side of the bit head, the adjustable cutter blade comprising a cutting element; and a gauge pad on the side of the bit head;

an actuator block coupled to the adjustable cutter blade and the gauge pad such that axial movement of the actuator block, with respect to the longitudinal axis of the bit head, results in a corresponding axial movement of the adjustable cutter blade and the gauge pad, with respect to the longitudinal axis of the bit head; and wherein the adjustable cutter blade and the gauge pad move in opposite radial directions, with respect to the longitudinal axis of the bit head, in response to the axial movement of the adjustable cutter blade and the gauge pad in a same axial direction, with respect to the longitudinal axis of the bit head.

12. The drill bit of claim 11, wherein the adjustable cutter blade and the gauge pad are moveable in a first axial direction, with respect to the longitudinal axis of the bit head, when a first pressure from within the drill bit is applied to a pressure ring coupled to the actuator block, and wherein the adjustable cutter blade and the gauge pad are moveable in a second axial direction, with respect to the longitudinal axis of the bit head, when a second pressure from within the drill bit is applied to the pressure ring coupled to the actuator block, wherein the second pressure is lower than the first pressure, and wherein the second axial direction is opposite the first axial direction.

13. The drill bit of claim 12, wherein the actuator block is biased by a spring element in the second axial direction, and wherein an uphole biasing force on the pressure ring from the spring element in combination with an annulus pressure from outside the drill bit is greater than a downhole biasing force on the pressure ring from the second pressure, such that the adjustable cutter blade and the gauge pad move in the second axial direction when the second pressure is applied.

14. A method of adjusting a characteristic of a drill bit, the method comprising:

while operating the drill bit within a wellbore, moving an adjustable cutter blade and a gauge pad in opposite radial directions, with respect to a longitudinal axis of the bit head, on a side of a bit head of the drill bit by moving the adjustable cutter blade and the gauge pad in a same axial direction, with respect to the longitudinal axis of the bit head, and wherein moving the adjustable cutter blade and the gauge pad in the same axial direction comprises axially moving an actuator block coupled to the adjustable cutter blade and the gauge pad, with respect to the longitudinal axis of the bit head.

15. The method of claim 14, moving the adjustable cutter blade and the gauge pad in opposite radial directions comprises adjusting the adjustable cutter blade to extend radially farther than the gauge pad when a rate of change of a direction of the drill bit is above a threshold.

16. The method of claim 14, moving the adjustable cutter blade and the gauge pad in opposite radial directions comprises adjusting the gauge pad to extend radially equal to or farther than the adjustable cutter blade when a rate of change of a direction of the drill bit is below a threshold.

17. The method of claim 14, wherein axially moving the actuator block, with respect to the longitudinal axis of the bit head, comprises operating a valve to adjust a pressure on a side of a pressure ring connected to the actuator block.

18. The method of claim 14, wherein moving the adjustable cutter blade and the gauge pad in opposite radial directions, with respect to the longitudinal axis of the bit head, comprises:

axially moving the adjustable cutter blade, with respect to the longitudinal axis of the bit head, along a blade ramp that radially deflects the adjustable cutter blade; and axially moving the gauge pad, with respect to the longitudinal axis of the bit head, along a gauge pad ramp that radially deflects the gauge pad.

19. The method of claim 14, further comprising:

measuring a current position of the drill bit in a well bore;

determining a required change in inclination and azimuth of the drill bit over a determined change in measured depth;

determining a required dogleg severity to achieve the required change in inclination and azimuth over a determined change in measured depth;

determining whether the required dogleg severity exceeds a threshold; and adjusting a radial position of the adjustable cutter blade and the gauge pad, with respect to the longitudinal axis of the bit head, based on the determining.

20. The method of claim 19, further comprising:

when the required dogleg severity exceeds a dogleg severity threshold, extending the adjustable cutter blade radially outward, with respect to the longitudinal axis of the bit head, relative to the gauge pad; and when the required dogleg severity does not exceed a dogleg severity threshold, extending the gauge pad radially outward, with respect to the longitudinal axis of the bit head, relative to the adjustable cutter blade.

* * * * *